US012522886B2

(12) United States Patent
Chae et al.

(10) Patent No.: US 12,522,886 B2
(45) Date of Patent: Jan. 13, 2026

(54) STEEL PLATE HAVING EXCELLENT STRENGTH AND LOW-TEMPERATURE IMPACT TOUGHNESS AND METHOD FOR MANUFACTURING SAME

(71) Applicant: POSCO, Pohang-si (KR)

(72) Inventors: Jae-Yong Chae, Pohang-si (KR); Hong-Ju Lee, Pohang-si (KR)

(73) Assignee: POSCO, Pohang-si (KR)

( * ) Notice: Subject to any disclaimer, the term of this patent is extended or adjusted under 35 U.S.C. 154(b) by 679 days.

(21) Appl. No.: 17/640,194

(22) PCT Filed: Aug. 28, 2020

(86) PCT No.: PCT/KR2020/011538

§ 371 (c)(1),
(2) Date: Mar. 3, 2022

(87) PCT Pub. No.: WO2021/045452

PCT Pub. Date: Mar. 11, 2021

(65) Prior Publication Data

US 2022/0340990 A1 Oct. 27, 2022

(30) Foreign Application Priority Data

Sep. 4, 2019 (KR) ..... 10-2019-0109539

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/002* (2013.01); *C21D 6/005* (2013.01); *C21D 6/007* (2013.01);
(Continued)

(58) Field of Classification Search
CPC ..... C21D 9/46; C21D 6/002; C21D 6/005; C21D 6/007; C21D 6/008; C21D 8/0205;
(Continued)

(56) References Cited

U.S. PATENT DOCUMENTS 3,907,553 A 9/1975 Nagumo et al.
6,203,634 B1 3/2001 Volkmuth
(Continued)

FOREIGN PATENT DOCUMENTS

CN 102046828 A 5/2011
CN 107109589 A 8/2017
(Continued)

OTHER PUBLICATIONS

Chinese Office Action dated May 9, 2022 issued in Chinese Patent Application No. 202080061497.1 (with English translation).
(Continued)

*Primary Examiner* — Nicholas A Wang
(74) *Attorney, Agent, or Firm* — Morgan Lewis & Bockius LLP

(57) ABSTRACT

A steel plate used in fields, such as industrial machinery, having excellent low-temperature impact toughness along with high strength and high hardness, and a method for manufacturing the same. The steel plate includes, by weight: 0.8 to 1.2% of carbon (C), 0.1 to 0.6% of manganese (Mn), 0.05 to 0.5% of silicon (Si), 0.02% or less of phosphorus (P), 0.01% or less of sulfur(S), 1.2 to 1.6% of chromium (Cr), and 1.0 to 2.0% of cobalt (Co), with a balance of Fe and other unavoidable impurities.

2 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/30*** | (2006.01) |

(52) U.S. Cl.
CPC ..... *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/28* (2013.01); *C22C 38/30* (2013.01); *C21D 2211/002* (2013.01); *C21D 2211/008* (2013.01)

(58) Field of Classification Search
CPC ..... C21D 8/0226; C21D 8/0263; C21D 2211/002; C21D 2211/008; C21D 1/18; C22C 38/02; C22C 38/04; C22C 38/30
See application file for complete search history.

(56) References Cited

U.S. PATENT DOCUMENTS

| | | | | |
|---|---|---|---|---|
| 2007/0163687 | A1 | 7/2007 | Kurosawa et al. | |
| 2007/0181231 | A1 | 8/2007 | Ueda et al. | |
| 2008/0247900 | A1* | 10/2008 | Hayashi | C22C 38/12 148/567 |
| 2011/0052442 | A1 | 3/2011 | Sherif et al. | |
| 2013/0167983 | A1* | 7/2013 | Clarke | C22C 38/22 148/333 |
| 2016/0010168 | A1* | 1/2016 | Angles | C22C 38/02 148/664 |
| 2018/0023156 | A1 | 1/2018 | Khutorsky et al. | |
| 2019/0100818 | A1 | 4/2019 | Kim et al. | |
| 2019/0390293 | A1 | 12/2019 | Yu et al. | |
| 2020/0071798 | A1 | 3/2020 | Hong | |
| 2020/0385840 | A1 | 12/2020 | Kim et al. | |

FOREIGN PATENT DOCUMENTS

| | | | | |
|---|---|---|---|---|
| CN | 110100034 | A | 8/2019 | |
| JP | 48-62617 | A | 9/1973 | |
| JP | 6-293939 | A | 10/1994 | |
| JP | 2000-345294 | A | 12/2000 | |
| JP | 2005-290544 | A | 10/2005 | |
| JP | 2006-052459 | A | 2/2006 | |
| JP | 2011-208257 | A | 10/2011 | |
| JP | 2013-213243 | A | 10/2013 | |
| JP | 2018-059189 | A | 4/2018 | |
| JP | 2018-150585 | A | 9/2018 | |
| KR | 10-2008-0060621 | A | 7/2008 | |
| KR | 10-0845633 | B1 | 7/2008 | |
| KR | 908624 | B1 * | 7/2009 | C22C 38/02 |
| KR | 10-2012-0063200 | A | 6/2012 | |
| KR | 10-2018-0010124 | A | 1/2018 | |
| KR | 10-2018-0071683 | A | 6/2018 | |
| KR | 10-2018-0073007 | A | 7/2018 | |
| KR | 10-2019-0076788 | A | 7/2019 | |
| WO | 2018/117482 | A1 | 6/2018 | |

OTHER PUBLICATIONS

European Search Report dated Mar. 15, 2023, issued in corresponding European Patent Application No. 20861202.8.
Japanese Office Action dated Apr. 18, 2023, issued in corresponding Japanese Patent Application No. 2022-513935.
International Search Report dated Dec. 1, 2020 issued in International Patent Application No. PCT/KR2020/011538 (with English translation).

* cited by examiner

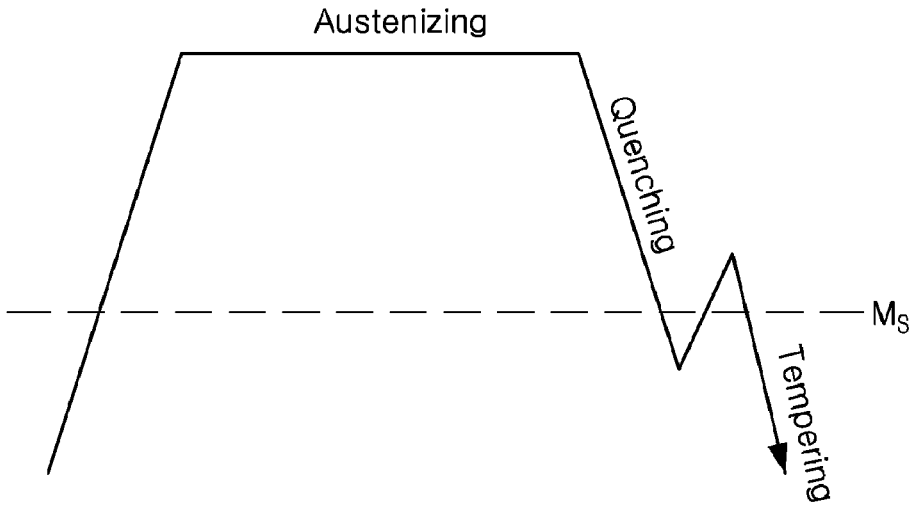
Austenizing
Quenching
$M_S$
Tempering

STEEL PLATE HAVING EXCELLENT STRENGTH AND LOW-TEMPERATURE IMPACT TOUGHNESS AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/011538, filed on Aug. 28, 2020, which in turn claims the benefit of Korean Application No. 10-2019-0109539, filed on Sep. 4, 2019, the entire disclosures of which applications are incorporated by reference herein.

TECHNICAL FIELD

The present disclosure relates to a steel plate used as a material of industrial machines, heavy equipment, tools, buildings, and the like, and more particularly, to a steel plate having excellent strength and low-temperature impact toughness, and a method for manufacturing the same.

BACKGROUND ART

Recently, as the need for extra-large industrial machines and heavy equipment has increased, a required amount of a steel plate used as a material thereof has increased.

In order to increase fuel economy and efficiency of the steel plate, demand for a high performance steel material having the same or a lower thickness and an exceptionally higher hardness than a conventional steel plate tends to be particularly increased.

In addition, for use in various environments, low-temperature impact toughness is also one of the properties required for a high performance steel plate.

However, since, among mechanical properties of the steel plate, strength and low-temperature impact toughness tend to be inversely proportional to each other, development of a technology for securing low-temperature impact toughness, together with high strength in a steel plate, is demanded.

Meanwhile, in order to improve low-temperature impact toughness, it is important to refine a particle size of a microstructure, so that a grain boundary bypasses a crack propagation path by impact. In the case of thick plate materials used in common industrial machines, construction, and the like, a method of aiming at particle size refinement by a thermomechanical control process (TMCP) is usually used, and in this method, finish rolling is carried out at or below a recrystallization stop temperature (RST) to form a strain band inside an austenite crystal grain and allow ferrite nucleation inside the strain band, thereby refining the particle size.

However, in the case of an extremely thick steel plate, the particle size refinement effect by the method described above is reduced in the center since the cooling rate is very low due to thickness thereof and a press-down amount applied in rolling is very low, and thus, the impact toughness in the center is decreased. Besides, a normalizing heat treatment which may be carried out after rolling forms coarse ferrite during cooling to decrease strength and make it difficult to secure low-temperature impact toughness.

As another method of improving impact toughness, a quenching heat treatment is performed after rolling to increase effective crystal grains through a packet or lath interface in a martensite or low-temperature bainite structure instead of a ferrite grain boundary, thereby bypassing a crack propagation path. Here, since there is a possibility of internal stress due to a rapid volume change involved in the phase transformation of bainite or martensite to rather accelerate crack initiation or propagation, generally, stress is relieved by a subsequent tempering heat treatment to stably secure impact toughness.

In this quenching-tempering heat treatment, the impact toughness value obtained is in a somewhat low, as compared with the thermal processing control method or the normalizing heat treatment, but in order to secure the high strength of the steel plate, a low-temperature bainite or martensite structure is essential, and thus, the method is used as a universal method for securing the impact toughness of a high strength steel plate.

However, since the method requires addition of a large amount of alloy for securing hardenability of the steel plate and a heat treatment process is performed twice (quenching-tempering), process costs rise.

Patent Document 1 mentions that the number of carbides is controlled to provide a nucleation site of reverse transformation austenite, thereby refining a crystal grain. However, there are various forms of carbides such as MC, $M_3C$, $M_7C_3$, $M_{23}C_6$ or the like, and the carbide such as MC and $M_3C$ is beneficial to provide the nucleation site of reverse transformation austenite, but the carbide such as $M_7C_3$ remains in a stable form even at a high temperature, so that it may be difficult to provide an austenite nucleation site. Therefore, it is difficult to consider that a simple increase in the number of carbides as in Patent Document 1 is effective for particle size refinement.

(Patent Document 1) Korean Patent Laid-Open Publication No. 10-2012-0063200

DISCLOSURE

Technical Problem

An aspect of the present disclosure is to provide a steel plate having better physical properties than conventional steel plates used in fields such as industrial machinery, in particular, having excellent low-temperature impact toughness along with high strength and high hardness, and a method for manufacturing the same.

An object of the present disclosure is not limited to the above description. The object of the present disclosure will be understood from the entire content of the present specification, and a person skilled in the art to which the present disclosure pertains will understand an additional object of the present disclosure without difficulty.

Technical Solution

According to an aspect of the present disclosure, a steel plate having excellent strength and low-temperature impact toughness includes, by weight: 0.8 to 1.2% of carbon (C), 0.1 to 0.6% of manganese (Mn), 0.05 to 0.5% of silicon (Si), 0.02% or less of phosphorus (P), 0.01% or less of sulfur (S), 1.2 to 1.6% of chromium (Cr), and 1.0 to 2.0% of cobalt (Co), with a balance of Fe and other unavoidable impurities.

According to another aspect of the present disclosure, a method for manufacturing a steel plate having excellent strength and low-temperature impact toughness includes: heating a steel slab having the alloy components described above to a temperature within a range of 1050 to 1250° C.; subjecting the heated steel slab to finish hot rolling at 900° C. or higher to manufacture a hot rolled steel sheet; after the hot rolling, cooling the hot rolled steel sheet to room temperature; reheating the cooled hot rolled steel sheet to a temperature within a range of 850 to 950° C.; water cooling the reheated hot rolled steel sheet to a temperature within a range of 200 to 300° C.; and subjecting the water cooled hot rolled steel sheet to a self-tempering heat treatment in a temperature within a range of 350 to 450° C. and then air cooling the steel sheet.

Advantageous Effects

As set forth above, according to an exemplary embodiment in the present disclosure, a steel plate having excellent low-temperature impact toughness while having high strength and hardness may be provided.

The steel plate of the present disclosure may be appropriately applied to extra-large industrial machines, heavy equipment, tools, buildings, and the like which may be used in various environments.

DESCRIPTION OF DRAWINGS

FIG. 1 is a schematic diagram of a self-tempering heat treatment process after quenching, according to an exemplary embodiment in the present disclosure.

BEST MODE FOR INVENTION

A conventional steel plate used in fields such as industrial machines has insufficient physical properties (such as strength and hardness) for being applied for large industrial machines and heavy equipment. When an alloy composition or manufacturing conditions of the steel plate are changed for solving the problem, low-temperature toughness becomes poor.

Thus, the present inventors intensively studied in order to develop a steel plate having excellent low-temperature impact toughness while having physical properties (strength and hardness) in an appropriate level for being used for large industrial machines or heavy equipment. As a result, it was confirmed that when a microstructure which is beneficial to secure intended physical properties is formed while optimizing the alloy composition and the manufacturing conditions, a steel plate having ultra-high strength of a tensile strength of 2000 MPa or more and excellent low-temperature impact toughness may be provided, and thus, the present disclosure has been completed.

Hereinafter, the present disclosure will be described in detail.

The steel plate having excellent strength and low-temperature impact toughness according to an exemplary embodiment in the present disclosure may include, by weight: 0.8 to 1.2% of carbon (C), 0.1 to 0.6% of manganese (Mn), 0.05 to 0.5% of silicon (Si), 0.02% or less of phosphorus (P), 0.01% or less of sulfur (S), 1.2 to 1.6% of chromium (Cr), and 1.0 to 2.0% of cobalt (Co), with a balance of Fe and other unavoidable impurities.

Hereinafter, the reason that the alloy composition of the steel plate provided in the present disclosure is limited as described above will be described in detail.

Meanwhile, unless otherwise particularly stated in the present disclosure, the content of each element is by weight and the ratio of the structure is by area.

Carbon (C): 0.8 to 1.2%

Carbon (C) is an element having the greatest influence on securing strength of the steel plate, and it is necessary to appropriately control the content.

When the content of C is less than 0.8%, the strength of the steel plate is unduly low, and it is difficult to use the steel plate as a material for an industrial machine and the like targeted in the present disclosure. However, when the content is more than 1.2%, the strength is unduly increased, and low-temperature toughness and weldability are decreased.

Therefore, C may be included at 0.8 to 1.2%, and more favorably at 0.85 to 1.15%.

Manganese (Mn): 0.1 to 0.6%

Manganese (Mn) is an element which is favorable to increase hardenability of steel to secure the strength of a steel sheet. In the present disclosure, certain amounts or more of C and Cr are included to sufficiently secure the hardenability of steel, and thus, Mn may be relatively decreased.

Mn tends to be segregated in a thickness center of the steel plate, and the segregated area of Mn as such has decreased impact toughness, so that a brittle structure is easily formed. Considering the fact, Mn may be included at 0.6% or less. However, when the content is unduly low, a targeted level of strength and the hardenability may not be secured only with the components such as C, Cr or the like, and thus, considering the fact, Mn may be included at 0.1% or more.

Therefore, Mn may be included at 0.1 to 0.6%, and more favorably at 0.2 to 0.5%.

Silicon (Si): 0.05 to 0.5%

Silicon (Si) is an element which is essential to increase the strength of steel and deoxidize molten steel. However, since Si suppresses formation of cementite when unstable austenite is decomposed, a martensite-austenite constituent (MA) structure is promoted to greatly impair low-temperature impact toughness.

Thus, considering the problem of decreasing the low-temperature impact toughness while obtaining the effect by Si, the content may be limited to 0.5% or less. Meanwhile, in order to excessively lower the content of Si, a process of refining steel costs a lot and there is a risk of economic loss, and thus, considering the fact, silicon may be included at 0.05% or more.

Phosphorus (P): 0.02% or Less

Phosphorus (P) is an element advantageous for improving the strength of steel and securing corrosion resistance, but since it is an element that greatly impairs the impact toughness, it is advantageous to control it as low as possible.

In the present disclosure, there is no great difficulty in securing the physical properties to be intended even when up to 0.02% of P is included, and thus, the content of P may be limited to 0.02% or less. However, considering the unavoidably added level, 0% may be excluded.

Sulfur (S): 0.01% or Less

Sulfur (S) is an element which is bonded to Mn in steel to form a non-metallic inclusion such as MnS and greatly impairs the impact toughness of steel. Thus, it is favorable to also control S as low as possible.

In the present disclosure, there is no great difficulty in securing the physical properties to be intended even when up to 0.01% of S is included, and thus, the content of S may be limited to 0.01% or less. However, considering the unavoidably added level, 0% may be excluded.

Chromium (Cr): 1.2 to 1.6%

Chromium (Cr) is an element which increases the hardenability of steel to have a great effect on strength improvement. In particular, in the present disclosure, Cr may be included at 1.2% or more in order to sufficiently improve the hardenability of steel with addition of C and Cr. However, when the content is excessive to be more than 1.6%, weldability is greatly deteriorated.

Therefore, Cr may be included at 1.2 to 1.6%, more favorably 1.3 to 1.55%.

Cobalt (Co): 1.0 to 2.0%

Cobalt (Co) is an element which is advantageous to form a microstructure favorable to the physical properties targeted in the present disclosure, and particularly plays a core role in producing lower bainite.

In addition, steel to which certain amounts of C and Cr are added as in the present disclosure delays the starting point of transformation of pearlite and upper bainite which may be produced during cooling to facilitate production of martensite. In this case, the starting point of transformation of lower bainite may be delayed.

When Co is included at a certain amount or more, the start of transformation of lower bainite is promoted, so that a certain fraction of lower bainite is introduced in the final structure, and thus, it is effective in securing low-temperature impact toughness which is limitedly secured with a martensite structure alone.

Besides, since Co has a high effect of solid solution strengthening or precipitation strengthening in the final microstructure, it is an element favorable to improve strength.

In order to sufficiently obtain the effect described above, Co may be included at 1.0% or more, but Co is a high-priced element and when it is excessively added, economic feasibility is reduced, and thus, considering the fact, the content may be limited to 2.0% or less.

Therefore, Co may be included at 1.0 to 2.0%, more favorably 1.2 to 1.8%.

The steel plate of the present disclosure may further include the following components, in terms of more favorably securing the physical properties of the steel plate, in addition to the alloy components described above.

One or more selected from the group consisting of 0.005 to 0.5% of aluminum (Al), 0.005 to 0.02% of titanium (Ti), and 0.01% or less of nitrogen (N)

Aluminum (Al) is an element effective for deoxidizing molten steel inexpensively, and for this, may be included at 0.005% or more. However, when the content is more than 0.5%, nozzle clogging is caused during continuous casting, and solid-solubilized Al may form a martensite-austenite constituent in a welded portion to deteriorate toughness of the welded portion.

Titanium (Ti) is bonded to nitrogen (N) in steel to form fine nitrides to relieve crystal grain coarsening which may occur near a welding melting line, thereby suppressing a decrease in toughness. When a content of Ti is unduly low, the number of Ti nitrides is insufficient, so that a crystal grain coarsening suppression effect becomes insufficient, and thus, considering the fact, Ti may be included at 0.005% or more. However, when Ti is added too much, coarse Ti nitrides are produced to decrease a crystal grain boundary fixation effect, and thus, considering the fact, the content may be limited to 0.02% or less.

Nitrogen (N) is bonded to Ti in steel to form fine nitrides, and relieves crystal grain coarsening which may occur near a welding melting line to suppress a decrease in toughness. However, when the content is excessive, toughness is rather greatly decreased, and thus, considering the fact, the content may be limited to 0.01% or less, and when N is added, 0% may be excluded.

The remaining component of the present disclosure is iron (Fe). However, since in the common manufacturing process, unintended impurities may be inevitably incorporated from raw materials or the surrounding environment, the component may not be excluded. Since these impurities are known to any person skilled in the common manufacturing process, the entire contents thereof are not particularly mentioned in the present specification.

The steel plate of the present disclosure having the alloy components described above may include a low-temperature bainite phase and a martensite phase as a microstructure.

Specifically, the low-temperature bainite phase refers to a lower bainite phase and may be included at an area fraction of 20 to 30%, and preferably a martensite phase is included as a remaining structure.

When a fraction of the low-temperature bainite phase is less than 20%, the low-temperature impact toughness of the steel may not be sufficiently secured, but when the fraction is more than 30%, the fraction of the martensite phase is relatively lowered, so that strength in the targeted level may not be secured.

As mentioned above, the steel plate of the present disclosure includes the low-temperature bainite (lower bainite) at a certain fraction in addition to a martensite phase, thereby improving the low-temperature impact toughness which is difficult to be obtained with the martensite phase alone.

Thus, the steel plate of the present disclosure has an effect of having an impact toughness at 0° C. of 40 J or more together with a tensile strength of 2000 MPa or more, and furthermore, may secure a Rockwell C hardness of 66 HRc or more.

Hereinafter, a method for manufacturing a steel plate having excellent strength and low-temperature impact toughness as another aspect of the present disclosure will be described in detail.

The steel plate of the present disclosure may be manufactured by subjecting a steel slab satisfying the alloying components suggested in the present disclosure to a process of [heating-hot rolling-cooling-reheating-water cooling], and in particular, the present disclosure is beneficial to secure a microstructure which is finally intended by self-tempering, after the water cooling.

Hereinafter, each process conditions will be described in detail.

[Steel Slab Heating]

In the present disclosure, the steel slab may be heated before hot rolling to solid-solubilize a Ti or Mn compound formed during casting, and at this time, a heating process may be performed in a temperature within a range of 1050 to 1250° C.

When the heating temperature of the steel slab is lower than 1050° C., the compound is not sufficiently solid-solubilized again, and a coarse compound remains. However, when the temperature is higher than 1250° C., strength is decreased by abnormal grain growth of an austenite crystal grain, which is thus not preferred.

[Hot Rolling]

The heated steel slab may be hot rolled to be manufactured into a hot rolled steel sheet, and at this time, after rough rolling under common conditions, finish hot rolling may be performed at a certain temperature.

In the case of the present disclosure, the hot rolled steel sheet obtained by hot rolling is reheated, and thus, the temperature at the time of finish hot rolling is not particularly limited. However, when the temperature is unduly low, a load of hot rolling is increased and a shape of a steel strip tends to be deteriorated, and thus, considering the fact, the finish hot rolling may be carried out at 900° C. or higher.

[Cooling and Reheating]

The hot rolled steel sheet manufactured according to the above may be air-cooled to room temperature, and reheated to a temperature at which a certain fraction of austenite is produced for a quenching heat treatment.

In the reheating, as the temperature is higher, a particle size is increased and hardenability is increased, and thus, a higher reheating temperature is beneficial to secure strength. However, when the temperature is unduly high, the particle size of austenite is excessively coarse, and the low-temperature impact toughness is deteriorated. Therefore, in the present disclosure, the reheating may be performed in a temperature within a range of 850 to 950° C.

After reheating the hot rolled steel sheet at the temperature described above, the steel sheet may be maintained so that heat is sufficiently transferred to the inside of the steel, and the time is appropriately selected depending on the thickness of the hot rolled steel sheet, and thus, the retention time herein is not particularly limited, but reheating may be performed for 20 minutes or more so that austenite phase transformation and crystal grain growth occur sufficiently.

[Water Cooling and Self-Tempering Heat Treatment]

After sufficiently transferring heat to the inside of the hot rolled steel sheet by the reheating, the steel sheet may be quenched by water cooling, and then subjected to a self-tempering heat treatment.

The water cooling may be performed at a cooling rate of 20 to 100° C./s, and for the self-tempering heat treatment as a subsequent process, it may be finished in a temperature within a range of 200 to 300° C.

When the cooling rate in water cooling is less than 20° C./s, a bainite phase may be excessively formed during the cooling, and when the cooling rate is more than 100° C./s, nonuniformity may occur by a cooling deviation between the surface and the center of the steel sheet.

When the cooling end temperature is lower than 200° C., heat in the hot rolled steel sheet is insufficient, so that a subsequent self-tempering heat treatment is not performed well, and when the temperature is higher than 300° C., an area fraction of a bainite phase produced during the cooling is unduly high, so that a martensite phase in the final structure may be insufficient.

On the hot rolled steel sheet which is water cooled to the temperature within a range described above, heat recuperation occurs to raise a temperature, so that a self-tempering heat treatment may be performed in a temperature within a range of 350 to 450° C. (FIG. 1).

In the self-tempering heat treatment, in a surface layer portion of the steel plate (as an example, referring to a ¼t region in a thickness direction (t, mm) from the surface), a certain fraction (area %) of a martensite structure produced during water cooling (quenching) is tempered, and at this time, internal stress is relieved to slightly decrease the strength and improve impact toughness. In addition, in a remaining austenite structure, transformation into lower bainite occurs, and bainite transformation heat occurs at this time, so that a heat recuperation temperature measured outside the steel sheet further rises partially.

Meanwhile, in the self-tempering heat treatment, cooling is stopped in the center (referring to the region other than the surface layer portion) at a higher temperature than in the surface layer portion, and thus, a state having a relatively low martensite fraction is formed. Though a temperature does not rise in the center directly after the cooling is finished, lower bainite transformation starts after some time, and a martensite structure which has been already produced by transformation heat is tempered to have improved impact toughness.

A highest temperature at which the steel plate is recuperated by the self-tempering heat treatment (highest heat recuperation temperature) is determined by a cooling end temperature and a fraction of transformed lower bainite, and when the steel plate is excessively recuperated and the temperature is higher than 450° C., martensite is excessively tempered, so that the targeted strength is not secured. However, when the heat recuperation temperature is lowered to lower than 350° C., internal stress is insufficiently relieved, so that impact toughness is not improved.

A time for the self-tempering heat treatment in the temperature within a range described above is not particularly limited, but usually a time taken to reach room temperature from a highest recuperative temperature is 30 minutes to 300 minutes, and the self-tempering may be performed during this time.

After completing the self-tempering heat treatment as described above, air cooling to room temperature is performed to obtain a final steel plate.

Hereinafter, the present disclosure will be specifically described through the following Examples. However, it should be noted that the following Examples are only for describing the present disclosure in detail by illustration, and are not intended to limit the right scope of the present disclosure. The reason is that the right scope of the present disclosure is determined by the matters described in the claims and reasonably inferred therefrom.

Mode for Invention

EXAMPLES

Steel slabs having the alloy components shown in Table 1 were prepared, and were subjected to each process under the conditions shown in Table 2 to manufacture hot rolled steel sheets.

A tensile specimen was collected in a width direction from each hot rolled steel sheet, a microstructure was observed, and room temperature (about 25° C.) tensile strength and low-temperature (0° C.) impact toughness were measured. At this time, the microstructure was observed at ×200 magnification using an optical microscope, and then a point count method in accordance with the specification of ASTM E562 was applied to measure the area fraction of each phase. A low-temperature impact toughness was measured using Charpy impact tester.

In addition, a Rockwell hardness tester was used to measure a Rockwell C hardness for the surface (surface of surface layer portion) of the tensile specimen.

Each resultant value is shown in the following Table 3.

TABLE 1

| | Alloy component (wt %) | | | | | | | | | | |
|---|---|---|---|---|---|---|---|---|---|---|---|
| Steel type | C | Mn | Si | P | S | Cr | Co | Al | Ti | Nb | N |
| Inventive steel 1 | 1.15 | 0.47 | 0.30 | 0.01 | 0.002 | 1.55 | 1.75 | 0.035 | 0.015 | 0 | 0.005 |
| Inventive | 1.02 | 0.33 | 0.27 | 0.01 | 0.002 | 1.38 | 1.51 | 0.032 | 0.012 | 0 | 0.004 |

TABLE 1-continued

| Steel type | Alloy component (wt %) | | | | | | | | | | |
|---|---|---|---|---|---|---|---|---|---|---|---|
| | C | Mn | Si | P | S | Cr | Co | Al | Ti | Nb | N |
| steel 2 | | | | | | | | | | | |
| Inventive steel 3 | 0.89 | 0.25 | 0.18 | 0.01 | 0.002 | 1.31 | 1.2 | 0.025 | 0.012 | 0 | 0.004 |
| Comparative steel 1 | 0.74 | 0.35 | 0.24 | 0.008 | 0.002 | 1.35 | 1.8 | 0.028 | 0.017 | 0.015 | 0.005 |
| Comparative steel 2 | 1.06 | 0.51 | 0.33 | 0.01 | 0.002 | 1.42 | 0 | 0.033 | 0.013 | 0 | 0.004 |
| Comparative steel 3 | 0.81 | 1.02 | 0.25 | 0.009 | 0.002 | 2.02 | 0 | 0.031 | 0.015 | 0 | 0.006 |

TABLE 2

| Steel type | Manufacturing conditions | Slab heating temperature (° C.) | Finish hot rolling temperature (° C.) | Reheating temperature (° C.) | Cooling rate (° C./s) | Cooling end temperature (° C.) | Self-tempering temperature (° C.) | Classification |
|---|---|---|---|---|---|---|---|---|
| Inventive steel 1 | 1-1 | 1137 | 930 | 910 | 80 | 240 | 380 | Inventive Example 1 |
| | 1-2 | 1142 | 840 | 910 | 90 | 250 | 390 | Comparative Example 1 |
| | 1-3 | 1129 | 970 | 1020 | 80 | 250 | 390 | Comparative Example 2 |
| Inventive steel 2 | 2-1 | 1180 | 960 | 890 | 60 | 250 | 400 | Inventive Example 2 |
| | 2-2 | 1024 | 940 | 900 | 25 | 250 | 390 | Comparative Example 3 |
| | 2-3 | 1210 | 920 | 830 | 40 | 250 | 400 | Comparative Example 4 |
| Inventive steel 3 | 3-1 | 1180 | 950 | 880 | 50 | 260 | 420 | Inventive Example 3 |
| | 3-2 | 1162 | 960 | 890 | 60 | 180 | 355 | Comparative Example 5 |
| | 3-3 | 1174 | 920 | 900 | 30 | 290 | 520 | Comparative Example 6 |
| Comparative steel 1 | 1-1 | 1170 | 910 | 900 | 60 | 250 | 360 | Comparative Example 7 |
| | 1-2 | 1175 | 940 | 900 | 50 | 260 | 380 | Comparative Example 8 |
| Comparative steel 2 | 2-1 | 1100 | 960 | 910 | 40 | 220 | 390 | Comparative Example 9 |
| | 2-3 | 1185 | 920 | 890 | 70 | 250 | 390 | Comparative Example 10 |
| Comparative steel 3 | 3-1 | 1146 | 930 | 880 | 60 | 230 | 410 | Comparative Example 11 |
| | 3-2 | 1152 | 980 | 900 | 60 | 260 | 400 | Comparative Example 12 |

TABLE 3

| Classification | Microstructure (area fraction %) | | Mechanical properties | | |
|---|---|---|---|---|---|
| | Martensite | Low-temperature bainite | Tensile strength (MPa) | Rockwell hardness (HRc) | Impact toughness (@0° C., J) |
| Inventive Example 1 | 75 | 25 | 2170 | 72 | 41 |
| Comparative Example 1 | 67 | 33 | 1980 | 65 | 43 |
| Comparative Example 2 | 69 | 31 | 2015 | 67 | 25 |
| Inventive Example 2 | 70 | 30 | 2049 | 68 | 44 |
| Comparative Example 3 | 64 | 36 | 1890 | 63 | 48 |
| Comparative Example 4 | 62 | 38 | 1850 | 62 | 49 |

TABLE 3-continued

| Classification | Microstructure (area fraction %) | | Mechanical properties | | |
|---|---|---|---|---|---|
| | Martensite | Low-temperature bainite | Tensile strength (MPa) | Rockwell hardness (HRc) | Impact toughness (@0° C., J) |
| Inventive Example 3 | 71 | 29 | 2078 | 69 | 43 |
| Comparative Example 5 | 87 | 13 | 2480 | 83 | 36 |
| Comparative Example 6 | 66 | 34 | 1948 | 65 | 46 |
| Comparative Example 7 | 47 | 53 | 1470 | 49 | 61 |
| Comparative Example 8 | 54 | 46 | 1650 | 55 | 55 |
| Comparative Example 9 | 62 | 38 | 1845 | 62 | 49 |

TABLE 3-continued

| Classification | Microstructure (area fraction %) | | Mechanical properties | | |
|---|---|---|---|---|---|
| | Martensite | Low-temperature bainite | Tensile strength (MPa) | Rockwell hardness (HRc) | Impact toughness (@0° C., J) |
| Comparative Example 10 | 84 | 16 | 2400 | 80 | 38 |
| Comparative Example 11 | 82 | 18 | 2352 | 78 | 38 |
| Comparative Example 12 | 82 | 18 | 2342 | 78 | 38 |

(In Table 3, low-temperature bainite refers to a lower bainite phase.)

As shown in Tables 1 to 3, it was confirmed that Inventive Examples 1 to 3 satisfying all of the alloy components and manufacturing conditions suggested in the present disclosure had a high hardness of 66 HRc or more together with ultra-high strength of a tensile strength of 2000 MPa or more, and excellently secured the low-temperature impact toughness of an impact toughness at 0° C. of 40 J or more.

However, in Comparative Example 1, the alloy composition satisfied the present disclosure, but among the process conditions, the finish hot rolling temperature was unduly low, so that an austenite crystal grain was excessively refined in a vertical direction to a rolling direction by non-recrystallized region rolling, and affected the particle size of reverse transformation austenite produced in the reheating later, and thus, the hardenability of the steel plate was decreased and a sufficient fraction of martensite phase was not produced. As a result, the tensile strength and the hardness of the steel plate were decreased.

In Comparative Example 2, the reheating temperature was unduly high, so that the austenite particle size was coarsened to increase the effective crystal grains of the final microstructure, and thus, impact toughness was decreased. Meanwhile, in Comparative Example 4, the reheating temperature was unduly low, and the austenite particle size was excessively decreased to decrease the hardenability of the steel plate, so that a sufficient fraction of martensite phase was not produced, and thus, the tensile strength and the hardness were decreased.

In Comparative Example 3, the temperature in the slab heating was unduly low, and some alloy elements were not solid-solubilized and the strength was decreased.

In Comparative Example 5, the cooling end temperature in cooling after reheating was unduly low, and a martensite fraction was excessively high so that the strength and the hardness may be secured, but low-temperature toughness was poor.

In Comparative Example 6, the temperature was excessively increased during self-tempering, and annealing of the martensite structure produced before was excessive to decrease strength and hardness.

In Comparative Examples 7 and 8, since Nb was added, a steel having a relatively decreased content of C was used, and it was confirmed that though the process followed the process conditions of the present disclosure, the strength and the hardness were greatly decreased.

In Comparative Examples 9 and 10, Co was not added to the steel, and it was confirmed that since the martensite structure was insufficiently produced or excessively produced depending on the cooling rate in the cooling after reheating, strength and hardness were decreased in Comparative Example 9, and impact toughness was decreased in Comparative Example 10.

In Comparative Examples 11 and 12, Mn and Cr were excessively added to steel, and the martensite structure was excessively produced to obtain targeted strength and hardness, but impact toughness was decreased.

The invention claimed is:

1. A steel plate consisting of, by weight: 0.8 to 1.2% of carbon (C), 0.1 to 0.6% of manganese (Mn), 0.05 to 0.5% of silicon (Si), 0.02% or less of phosphorus (P), 0.01% or less of sulfur(S), 1.2 to 1.6% of chromium (Cr), and 1.0 to 2.0% of cobalt (Co), with a balance of Fe and other unavoidable impurities, wherein the steel plate includes a low-temperature bainite phase having an area fraction of 25 to 30%, and a remaining martensite phase, and wherein the steel plate has a tensile strength of 2000 MPa or more and an impact toughness at 0° C. of 40 J or more.

2. The steel plate of claim 1, wherein the steel plate has a Rockwell C hardness of 66 HRc or more.

* * * * *